US008570254B2

(12) United States Patent
Isobe

(10) Patent No.: US 8,570,254 B2
(45) Date of Patent: Oct. 29, 2013

(54) DISPLAY APPARATUS AND IMAGING SYSTEM

(75) Inventor: Ryuichiro Isobe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/670,959

(22) PCT Filed: Aug. 27, 2008

(86) PCT No.: PCT/JP2008/065786
§ 371 (c)(1),
(2), (4) Date: Jan. 27, 2010

(87) PCT Pub. No.: WO2009/031547
PCT Pub. Date: Mar. 12, 2009

(65) Prior Publication Data

US 2010/0194671 A1 Aug. 5, 2010

(30) Foreign Application Priority Data

Sep. 3, 2007 (JP) ..... 2007-227440

(51) Int. Cl.
*G09G 3/30* (2006.01)

(52) U.S. Cl.
USPC ..... 345/77; 345/63; 345/76; 345/581; 345/589; 345/593

(58) Field of Classification Search
None
See application file for complete search history.

(56) References Cited

U.S. PATENT DOCUMENTS

| | | | | |
|---|---|---|---|---|
| 2004/0046725 | A1* | 3/2004 | Lee | 345/88 |
| 2006/0214942 | A1 | 9/2006 | Tanase et al. | 345/589 |
| 2007/0058108 | A1* | 3/2007 | Uehara et al. | 349/86 |
| 2007/0109284 | A1* | 5/2007 | Yamazaki et al. | 345/204 |
| 2008/0297448 | A1 | 12/2008 | Mizukoshi et al. | 345/76 |
| 2009/0170564 | A1* | 7/2009 | Mori et al. | 455/566 |
| 2011/0279029 | A1* | 11/2011 | Hirakata et al. | 313/504 |

FOREIGN PATENT DOCUMENTS

| | | |
|---|---|---|
| JP | 2003-178875 | 6/2003 |
| JP | 2006-003475 | 1/2006 |

OTHER PUBLICATIONS

PCT International Search Report and Written Opinion of International Search Authority in PCT/JP2008/065786 issued Nov. 14, 2008.

* cited by examiner

*Primary Examiner* — William Boddie
*Assistant Examiner* — Alecia D English
(74) *Attorney, Agent, or Firm* — Fitzpatrick, Cella, Harper & Scinto

(57) ABSTRACT

Provided is a display apparatus, in which a deterioration of a display device in an icon display region is reduced to lower the occurrence of burn-in. The display apparatus includes multiple pixels each including sub-pixels of red, green, blue and white, which are arranged in matrix and a color operation circuit for converting an image signal into a driving signal for the sub-pixels, in which each of the sub pixels includes an electroluminescence device and the color operation circuit adjusts a luminance ratio between the sub-pixels of red, green and blue and the sub-pixel of white based on a display region.

8 Claims, 4 Drawing Sheets

DISPLAY APPARATUS AND IMAGING SYSTEM

TECHNICAL FIELD

The present invention relates to a small-size full-color display apparatus using a display device by means of electroluminescence, and to an imaging system using the display apparatus, such as a digital camera.

BACKGROUND ART

In recent years, as a display apparatus using a display device by means of electroluminescence, in Japanese Patent Application Laid-Open No. 2003-178875, a technique using sub-pixels of four colors of red, green, blue and white is described.

In this technique, a white color display device on which a color filter is stacked is used for display of red, green and blue, and only a white color display device is used for white display. As a result, the color filter is prevented from absorbing light at the time of white display, thereby being capable of suppressing power consumption.

Japanese Patent Application Laid-Open No. 2006-3475 also discloses a technique, in which a luminance ratio between red, green and blue sub-pixels and a white sub-pixel is dynamically adjusted based on detection of a region of display image having high spatial frequency, average power consumption, amount of current and a battery capacity. Therefore, the power consumption is suppressed while the display quality is prevented from deteriorating.

There is a case where a display device using a self-emission phenomenon, such as the electroluminescence device, may deteriorate due to an emission luminance or emission time. The deterioration occurs in the case where the emission luminance is high or the case where light emission continues for a long period of time. When the same image is being displayed on the display apparatus for a long period of time, the deterioration may visually be recognized as a burn-in phenomenon.

In many cases, an image or a symbol, which is obtained by abstracting information, is displayed on a system such as a digital camera or a mobile phone in order to transmit system information to a user. The image or symbol is called an icon and displayed on the display apparatus at a predetermined position for a long period of time in many cases. Therefore, a display device in an icon display region deteriorates earlier than a display device in a region other than the icon display region. Thus, when an image including no icon is displayed, the icon display region may visually be recognized as burn-in.

DISCLOSURE OF THE INVENTION

It is an object of the present invention to provide a display apparatus, in which red, green, blue and white sub-pixels are used, and deterioration of a display device in an icon display region is reduced to lower the occurrence of burn-in, and an imaging system using the display apparatus.

Specifically, the present invention provides a display apparatus including:

a substrate;

multiple pixels each including sub-pixels of red, green, blue and white, the pixels being arranged in matrix on the substrate; and a color operation circuit for converting an image signal into a driving signal for the sub-pixels, in which:

each of the sub pixels includes an electroluminescence device; and the color operation circuit adjusts a luminance ratio between the sub-pixels of red, green and blue and the sub-pixel of white based on a display region.

Further features of the present invention will become apparent from the following description of exemplary embodiments with reference to the attach drawings.

BEST MODE FOR CARRYING OUT THE INVENTION

Figure 1:
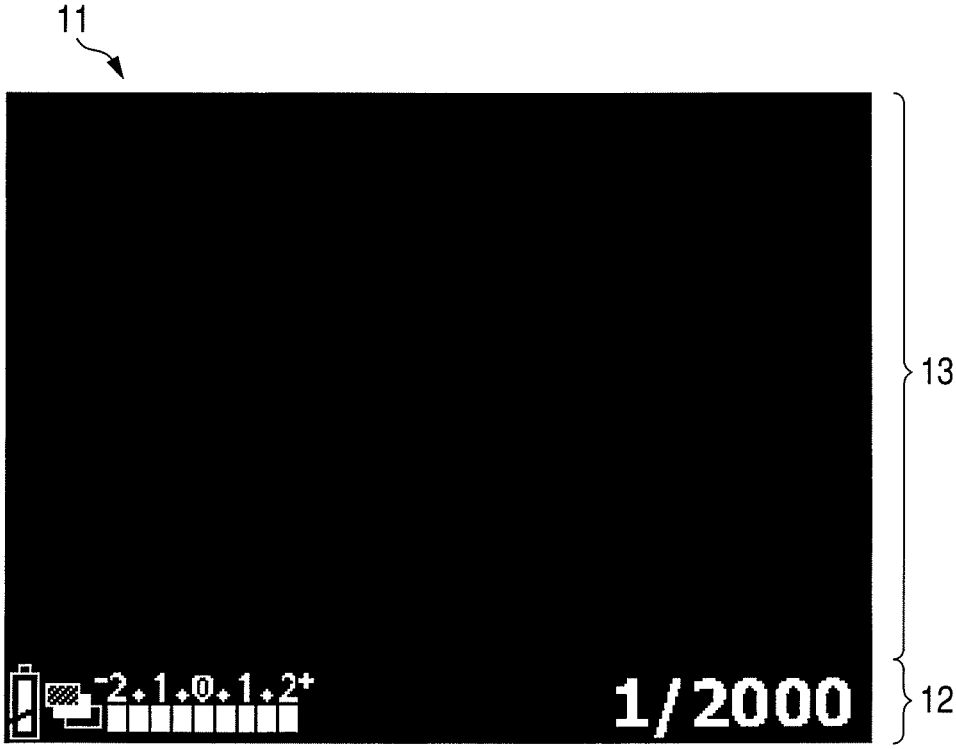
FIG. 1 illustrates an example of a display image displayed on a display panel.

FIG. 1 illustrates a typical image displayed on a display apparatus used for an imaging system such as a digital camera.

In the case of the digital camera, an image obtained by photographing or an image signal from a CCD or a CMOS area sensor is displayed on a natural image display region 13. System information including a shutter speed and a remaining battery level is displayed on an icon display region 12. The system information is superimposed on the image (or image signal) to form a display image 11.

A shape of the icon display region 12 and a position thereof on the display image 11 are determined at the time of system design. Therefore, the shape and the position are hardly adjusted by a user during the use of the display apparatus. The information is displayed with white color on the icon display region 12 in view of visibility in many cases. In general, when the information is to be displayed with only white color on the icon display region 12 using red, green, blue and white sub-pixels, the display using only the white sub-pixels is desirable in order to suppress power consumption. However, since an area of the icon display region 12 is much smaller compared with an area of the display image 11, even when the information is displayed on the icon display region 12 using only the white sub-pixels, an effect on the entire power consumption is small. The inventor of the present invention has found that, because only the white sub-pixels are used for the icon display region 12, a display device in the icon display region 12 may deteriorate earlier than a display device in the natural image display region 13 to cause burn-in.

Therefore, according to the display apparatus in the present invention, a luminance ratio between the red, green and blue sub-pixels and the white sub-pixel is adjusted according to a display region.

Hereinafter, the display apparatus according to the present invention is specifically described. In the display apparatus according to an embodiment of the present invention, the information is displayed with white color on the icon display region 12 of the display apparatus using all the red, green, blue and white sub-pixels, and the image is displayed with white color on the natural image display region 13 using only the white sub-pixels. However, the present invention is not limited to this embodiment. For example, the luminance ratio between the red, green and blue sub-pixels and the white sub-pixel may be set to a continuous ratio between 1:0 and 0:1 based on an icon display color.

Figure 2:
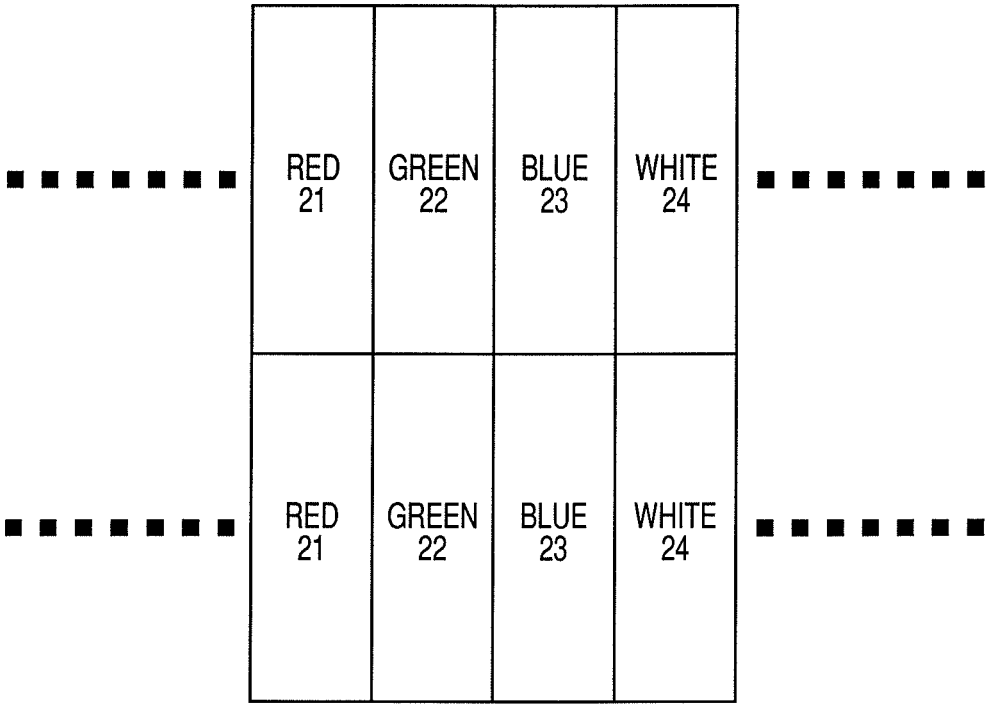
FIG. 2 is an explanatory view illustrating a structure of a pixel including three-primary color sub-pixels.

FIG. 2 illustrates an arrangement of the sub-pixels for displaying an image on the display apparatus to which the present invention can be applied. As is illustrated in FIG. 2, red sub-pixels 21, green sub-pixels 22, blue sub-pixels 23 and white sub-pixels 24 are arranged in matrix in the display apparatus.

When signals for controlling the red sub-pixels 21, the green sub-pixels 22, the blue sub-pixels 23 and the white sub-pixels 24 are expressed by R', G', B' and W' and when displayed original sub-pixel signals are expressed by R, G, and B, the following conversion is performed.

In the case of the natural image display region 13, the conversion is performed by the following expression.

$$\begin{pmatrix} R' \\ G' \\ B' \\ W' \end{pmatrix} = \begin{pmatrix} 1000 \\ 0100 \\ 0010 \\ 0001 \end{pmatrix} \begin{pmatrix} R - \min(R, G, B) \\ G - \min(R, G, B) \\ B - \min(R, G, B) \\ \min(R, G, B) \end{pmatrix}$$

In the expression, min(R, G, B) means a minimum signal of the signals R, G and B. As is apparent from the expression, when white or gray scale display is to be performed on the natural image display region 13, R'=G'=B'=0, and hence only the white sub-pixels 24 are lighted.

In the case of the icon display region 12, the conversion is performed by the following expressions.

$$\begin{pmatrix} R' \\ G' \\ B' \\ W' \end{pmatrix} = \begin{pmatrix} 1000 \\ 0100 \\ 0010 \\ 0001 \end{pmatrix} \begin{pmatrix} R - \min(R, G, B) \\ G - \min(R, G, B) \\ B - \min(R, G, B) \\ \min(R, G, B) \end{pmatrix} \text{ when } R \neq G \neq B$$

$$\begin{pmatrix} R' \\ G' \\ B' \\ W' \end{pmatrix} = \begin{pmatrix} 1000 \\ 0100 \\ 0010 \\ 0001 \end{pmatrix} \begin{pmatrix} R/2 \\ R/2 \\ R/2 \\ R/2 \end{pmatrix} \text{ when } R = G = B$$

As described above, when the display with R=G=B=0, that is, the gray scale display is to be performed on the icon display region 12, all the red, green, blue and white sub-pixels may be lighted and a display level of each of the sub-pixels may be set to ½. Therefore, a desirable display luminance is halved compared with the case where only the white sub-pixels 24 are lighted. Thus, the deterioration of the display devices (white sub-pixels 24) can be reduced to suppress the burn-in of the display device in the icon display region 12.

Figure 3:
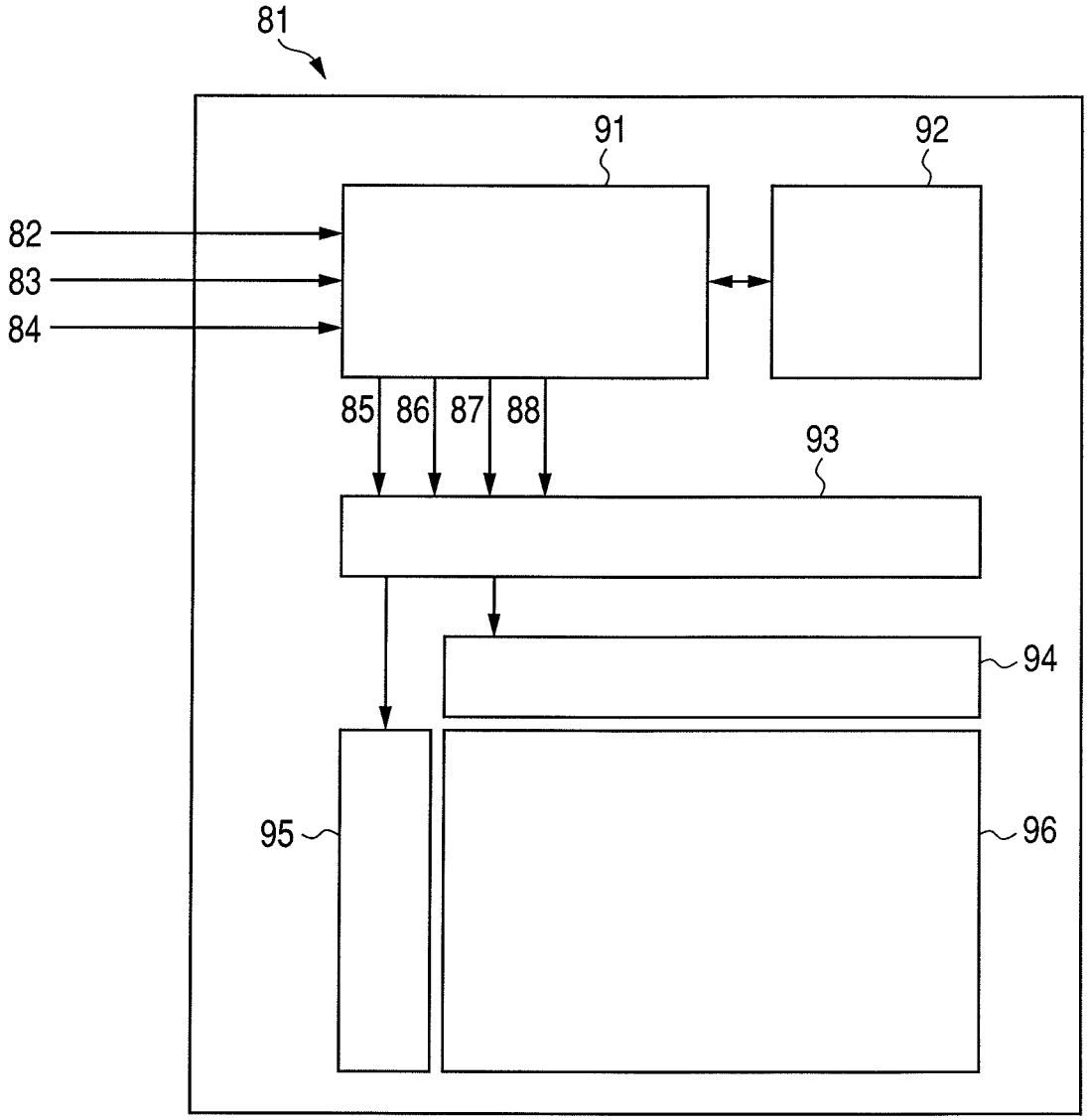
FIG. 3 is a block diagram illustrating a display apparatus to which the present invention can be applied.

FIG. 3 is a block diagram illustrating a display apparatus to which the present invention can be applied.

In FIG. 3, color signals 82, 83 and 84 corresponding to the color signals R, G and B are input to a display apparatus 81. The input color signals 82, 83 and 84 are converted by a color operation circuit 91, using the conversion expressions described above, into color signals 85, 86, 87 and 88 (drive signals) of red, green, blue and white colors (R', G', B' and W') and then input to a driver 93.

In the color operation circuit 91, color information for a certain pixel is converted into red, green and blue color signals based on the mechanism described above. In this case, the color operation circuit 91 reads out position information of the icon display region 12 from a storage device 92 and determines the switching between the conversion expressions described above. When the display apparatus is manufactured, the position information of the icon display region 12 is stored in the storage device 92.

The color information input to the driver 93 are input to a display panel 96 through a row drive circuit 95 and a column drive circuit 94 in synchronization with synchronizing signals (not shown) to display a desirable image.

A self-emission display panel using an electroluminescence device can be used as the display panel 96.

FIG. 3 illustrates the structure in which the color operation circuit 91 and the driver 93, the column drive circuit 94, and the row drive circuit 95, which are used to drive the display panel 96, are separated from one another. However, the actual display apparatus 81 does not necessarily include separated circuits. The driver 93, the column drive circuit 94, and the row drive circuit 95 may be formed by the same process on the display panel 96 manufactured using a low-temperature polysilicon TFT substrate. The entire display apparatus 81 may also be manufactured on a single-crystal silicon substrate.

Figure 4:
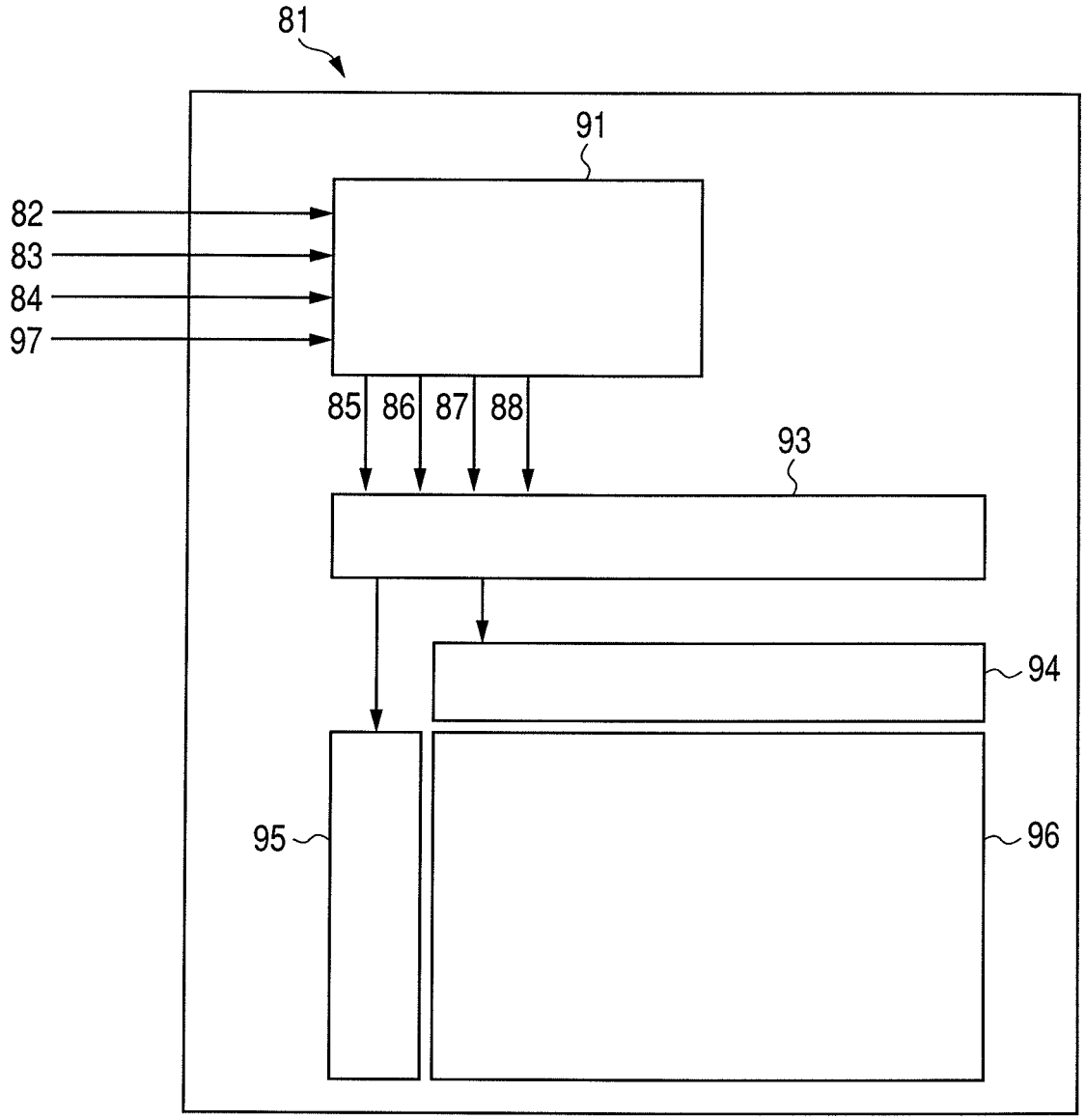
FIG. 4 is a block diagram illustrating another example of the display apparatus to which the present invention can be applied.

FIG. 4 is a block diagram illustrating another example of the display apparatus to which the present invention can be applied. In this example, the storage device in which the display position information of the icon display region 12 is stored is not provided in the display apparatus 81. A display region determination signal 97 synchronized with the color signals 82, 83 and 84 is separately input to the display apparatus 81 (color operation circuit 91). Therefore, not only a single icon display region but also multiple icon display regions can be dynamically switched according to the usage pattern of a user. In FIG. 4, the same reference numerals are used for the same components as in FIG. 3.

In this embodiment, the color operation circuit 91 is provided in the display apparatus. When the display apparatus is to be incorporated in an imaging system such as a digital camera, a controller of the imaging system is provided with a function corresponding to the color operation circuit 91, and hence the same effect can be obtained.

When the imaging system includes a display unit having the display apparatus with the structure described above and an imaging unit, the deterioration of the display devices (white sub-pixels) can be reduced to suppress the burn-in of the display device in the icon display region.

As described above, according to the display apparatus in the present invention and the imaging system using the display apparatus, the luminance ratio between the red, green and blue sub-pixels and the white sub-pixel is adjusted according to the display region. For example, the white sub-pixel is used in the natural image display region at the time of white color display as in the conventional case. In the icon display region, not only the white sub-pixel but also all the red, green and blue sub-pixels are lighted to mix light from the respective sub-pixel, thereby performing white color display. Therefore, the deterioration of the white sub-pixels in the icon display region can be reduced to suppress the burn-in of the white sub-pixels in the icon display region.

This application claims the benefit of Japanese Patent Application No. 2007-227440, filed Sep. 3, 2007, which is hereby incorporated by reference herein in its entirety.

The invention claimed is:

1. A display apparatus comprising:

multiple pixels each including sub-pixels of red, green, blue and white; and a color operation circuit for converting an image signal inputted from the outside of the display apparatus into the inside of the display apparatus into a driving signal for the sub-pixels, wherein each of the sub pixels includes an electroluminescence device, wherein the color operation circuit adjusts a luminance ratio between the sub-pixels of red, green and blue and the sub pixel of white based on a display region determination signal, which represents display position information of an icon display region, is inputted from the outside of the display apparatus, and is synchronized with the image signal, and wherein during performing gray scale display other than black, the color operation circuit makes a larger than zero luminance ratio of each of red, green, and blue when the display region determination signal represents the icon display region, and the color operation circuit makes a zero luminance ratio of each of red, green, and blue when the display region determination signal represents a natural image display region.

2. An imaging system comprising:

a display unit including the display apparatus according to claim 1; and an imaging unit connected with the display unit.

3. The display apparatus according to claim 1, wherein, at the time of manufacture of the display apparatus, display position information of the icon display region is not stored in a storage device in the display apparatus.

4. A display apparatus comprising:

multiple pixels each including sub-pixels of red, green, blue and white, each sub-pixel including an electroluminescence device;

a color operation circuit for inputting, from outside the display apparatus, both (a) an image signal and (b) a display region determination signal identifying display position information of an icon display region, and for generating a driving signal for the sub-pixels in accordance with the image signal and the display region determination signal; and a display that displays an image in accordance with the driving signal, wherein the color operation circuit adjusts a luminance ratio between the sub-pixels of red, green, and blue, and the sub-pixel of white based on the display region determination signal, wherein the display region determination signal is separate from and synchronized with the image signal, and wherein the color operation circuit, for a gray scale pixel in the icon display region, lights all of the red, green, blue, and white sub-pixels and sets the display level of each of the sub-pixels to one-half.

5. A display apparatus according to claim 4, wherein the color operation circuit, for a pixel in the icon display region where $R \neq G \neq B$, sets the white sub-pixel luminance to the minimum of R, G, and B.

6. A display apparatus according to claim 4, wherein the icon display region is switched according to a usage pattern of a user.

7. A display apparatus according to claim 4, wherein the driving signal for the sub-pixels comprises R, G, B, and W signals, and wherein the display apparatus further comprises a column drive circuit and a row drive circuit that are driven in accordance with the R, G, B, and W signals.

8. A display apparatus according to claim 4, wherein a storage device storing the display position information of the icon display region is not provided in the display apparatus.

* * * * *